US007690858B1

(12) United States Patent
Chiavola

(10) Patent No.: US 7,690,858 B1
(45) Date of Patent: Apr. 6, 2010

(54) COMMERCIAL VEHICLE SAFETY BARRIER

(76) Inventor: Vincent Chiavola, 547 East Dr., Lindenhurst, NY (US) 11757

( * ) Notice: Subject to any disclaimer, the term of this patent is extended or adjusted under 35 U.S.C. 154(b) by 78 days.

(21) Appl. No.: 12/027,723

(22) Filed: Feb. 7, 2008

(51) Int. Cl.
*G08G 1/005* (2006.01)
*E01F 9/019* (2006.01)

(52) U.S. Cl. ..... 404/6; 404/9; 340/908

(58) Field of Classification Search ..... 404/6, 404/9; 340/908
See application file for complete search history.

(56) References Cited

U.S. PATENT DOCUMENTS

| | | | | | |
|---|---|---|---|---|---|
| 2,834,314 | A * | 5/1958 | Moore | 116/63 R |
| 3,050,075 | A | 8/1962 | Kaplan et al. | |
| 3,782,322 | A * | 1/1974 | Wilson | 116/63 P |
| 3,917,231 | A * | 11/1975 | Fink | 256/64 |
| 4,124,196 | A * | 11/1978 | Hipskind | 256/1 |
| 4,844,420 | A * | 7/1989 | Oster | 256/1 |
| 4,879,162 | A * | 11/1989 | Hansen, Sr. | 428/196 |
| 4,971,384 | A | 11/1990 | Baldwin | |
| 5,110,172 | A | 5/1992 | Ney et al. | |
| D338,439 | S | 8/1993 | Avila | |
| 5,722,611 | A * | 3/1998 | Schmid et al. | 242/376 |
| 6,217,253 | B1 * | 4/2001 | Eslambolchi et al. | 404/93 |
| 6,971,329 | B1 * | 12/2005 | Stewart | 116/63 C |
| 2003/0033742 | A1 * | 2/2003 | Perelli et al. | 40/606 |
| 2003/0164485 | A1 | 9/2003 | Olson et al. | |
| 2004/0018790 | A1 * | 1/2004 | Kumar et al. | 442/286 |
| 2004/0060499 | A1 * | 4/2004 | Penque, Jr. | 116/63 P |
| 2005/0048258 | A1 * | 3/2005 | Kuchar | 428/131 |
| 2005/0220537 | A1 * | 10/2005 | Bentley | 404/9 |
| 2006/0140717 | A1 | 6/2006 | Lamore | |

* cited by examiner

*Primary Examiner*—Raymond W Addie
(74) *Attorney, Agent, or Firm*—Crossley Patent Law; Mark Ashley Crossley

(57) ABSTRACT

A commercial vehicle safety barrier that is designed to assist a commercial tanker truck when delivering gasoline to a service station by keeping pedestrians and motorists away from the vehicle while the fuel was being unloaded. The barrier is fabricated from four separate casings that are mounted to the side of a commercial fuel tanker trunk. The casings are mounted to the same side of the truck on which the hose manifolds are located. Each casing includes a nylon strap attached to a retractable, spring-loaded reel, allowing each nylon strap to be pulled out and attached to a portable cone via a hook located on the nylon strap. The strap may contain a message to notify passersby of danger or an emergency. The barrier may also be used to assist police and emergency vehicles, as well as utility workers to notify passersby of danger or an emergency.

11 Claims, 6 Drawing Sheets

COMMERCIAL VEHICLE SAFETY BARRIER

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The present invention concerns that of a new and improved commercial vehicle safety barrier that is designed to assist a commercial tanker truck when delivering gasoline to a service station by keeping pedestrians and motorists away from the vehicle while the fuel was being unloaded.

SUMMARY OF THE INVENTION

The present invention concerns that of a new and improved commercial vehicle safety barrier that is designed to assist a commercial tanker truck when delivering gasoline to a service station by keeping pedestrians and motorists away from the vehicle while the fuel was being unloaded. The barrier may also be used to assist police and emergency vehicles as well as utility trucks. The barrier is fabricated from four separate casings that are mounted to the side of a commercial fuel tanker trunk. The casings are mounted to the same side of the truck on which the hose manifolds are located. Each casing includes a nylon strap attached to a retractable, spring-loaded reel, allowing each nylon strap to be pulled out and attached to a portable cone via a hook located on the nylon strap. Each strap may display a message. For example, the message may read "DO NOT ENTER' or "Danger—Gasoline—No Smoking" or other words indicating the presence of a dangerous or emergency situation or other situation requiring attention. Each strap may be provided in a variety of colors including, but not limited to, bright colors and neon colors.

There has thus been outlined, rather broadly, the more important features of a commercial vehicle safety barrier that the detailed description thereof that follows may be better understood and in order that the present contribution to the art may be better appreciated. There are, of course, additional features of the commercial vehicle safety barrier that will be described hereinafter and which will form the subject matter of the claims appended hereto.

In this respect, before explaining at least one embodiment of the commercial vehicle safety barrier in detail, it is to be understood that the commercial vehicle safety barrier is not limited in its application to the details of construction and to the arrangements of the components set forth in the following description or illustrated in the drawings. The commercial vehicle safety barrier is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the commercial vehicle safety barrier. It is important, therefore, that the claims be regarded as including such equivalent constructions insofar as they do not depart from the spirit and scope of the present invention.

It is therefore an object of the present invention to provide a commercial vehicle safety barrier which has all of the advantages of the prior art and none of the disadvantages.

It is another object of the present invention to provide a commercial vehicle safety barrier which may be easily and efficiently manufactured and marketed.

It is another object of the present invention to provide a commercial vehicle safety barrier which is of durable and reliable construction.

It is yet another object of the present invention to provide a commercial vehicle safety barrier which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
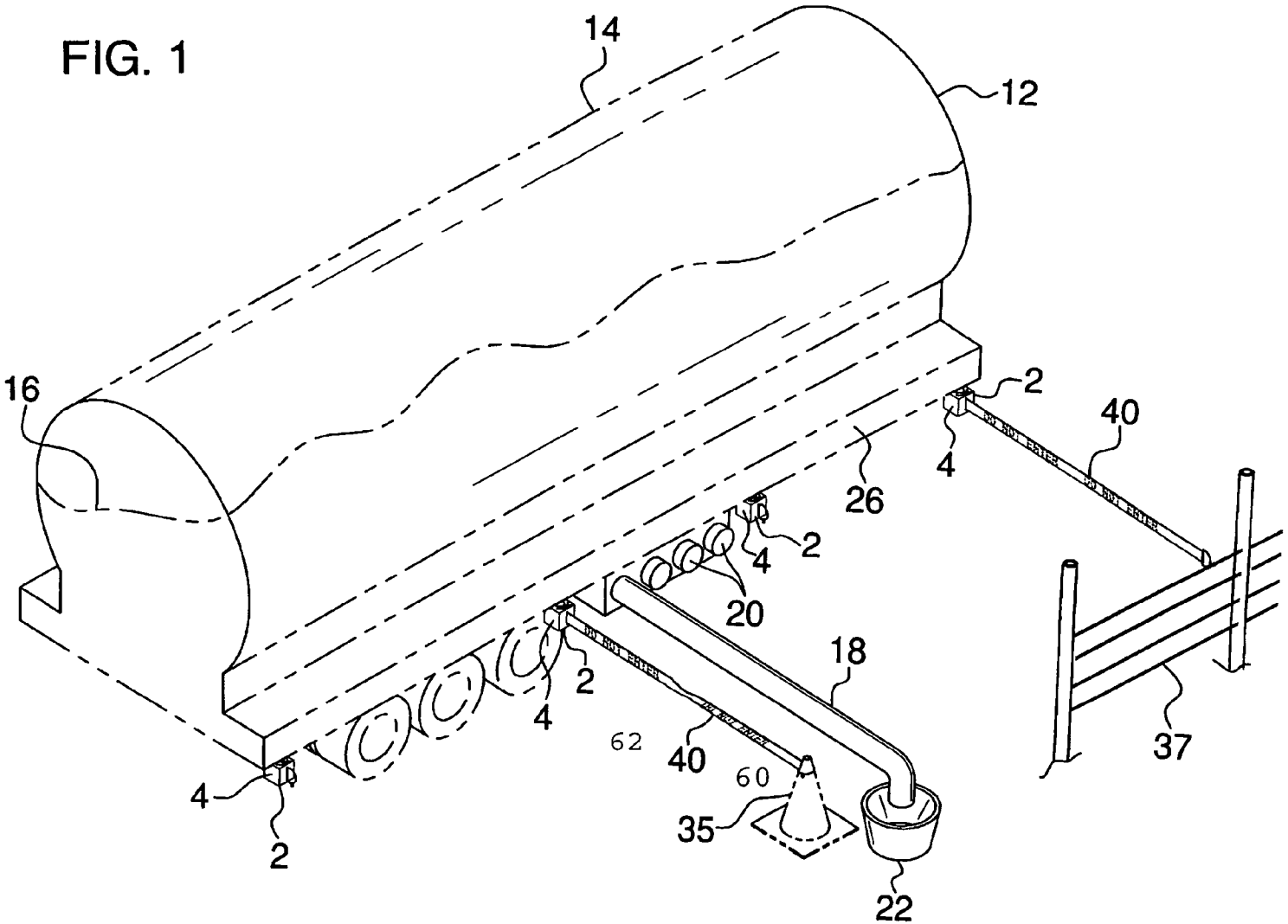
FIG. 1 shows a rear perspective view of a tank portion of a tanker truck, highlighting a pair of extended nylon straps.
Figure 2:
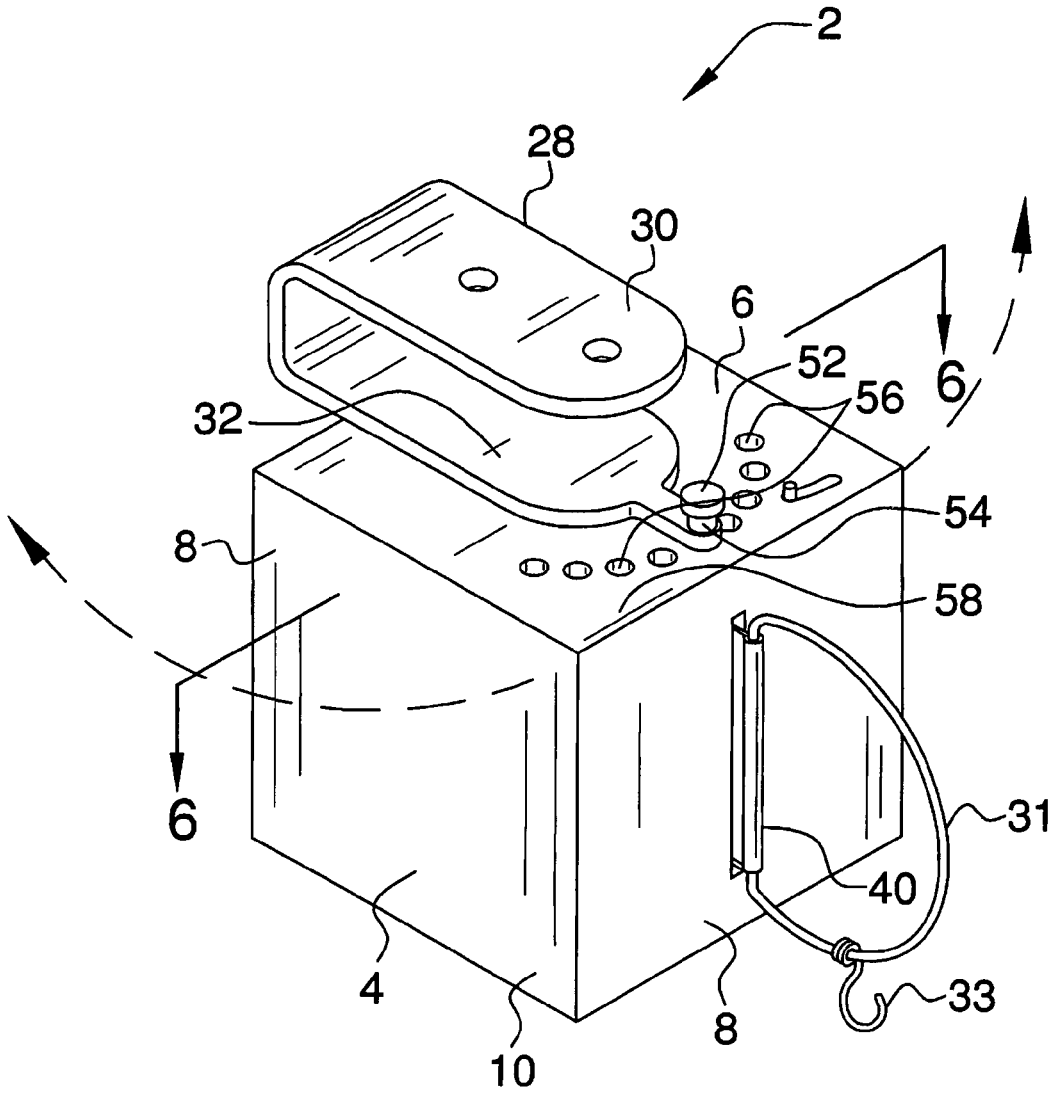
FIG. 2 shows a close-up perspective view of a casing that is used to house a particular nylon strap while it is not in use.
Figure 3:
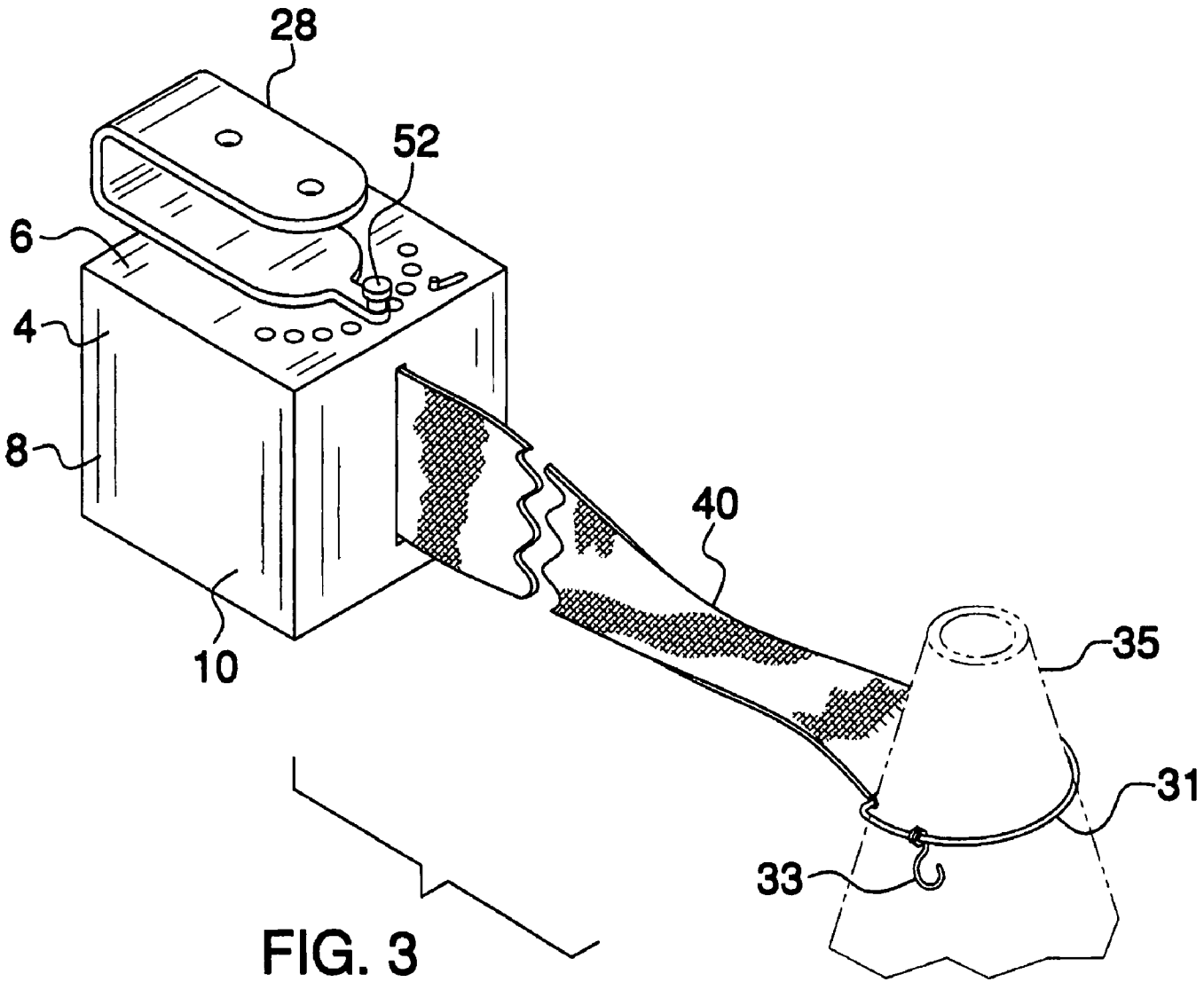
FIG. 3 shows a front perspective view of a casing, highlighting the nylon stand that has been extended out of the casing and attached to a cone for barrier protection.
Figure 4:
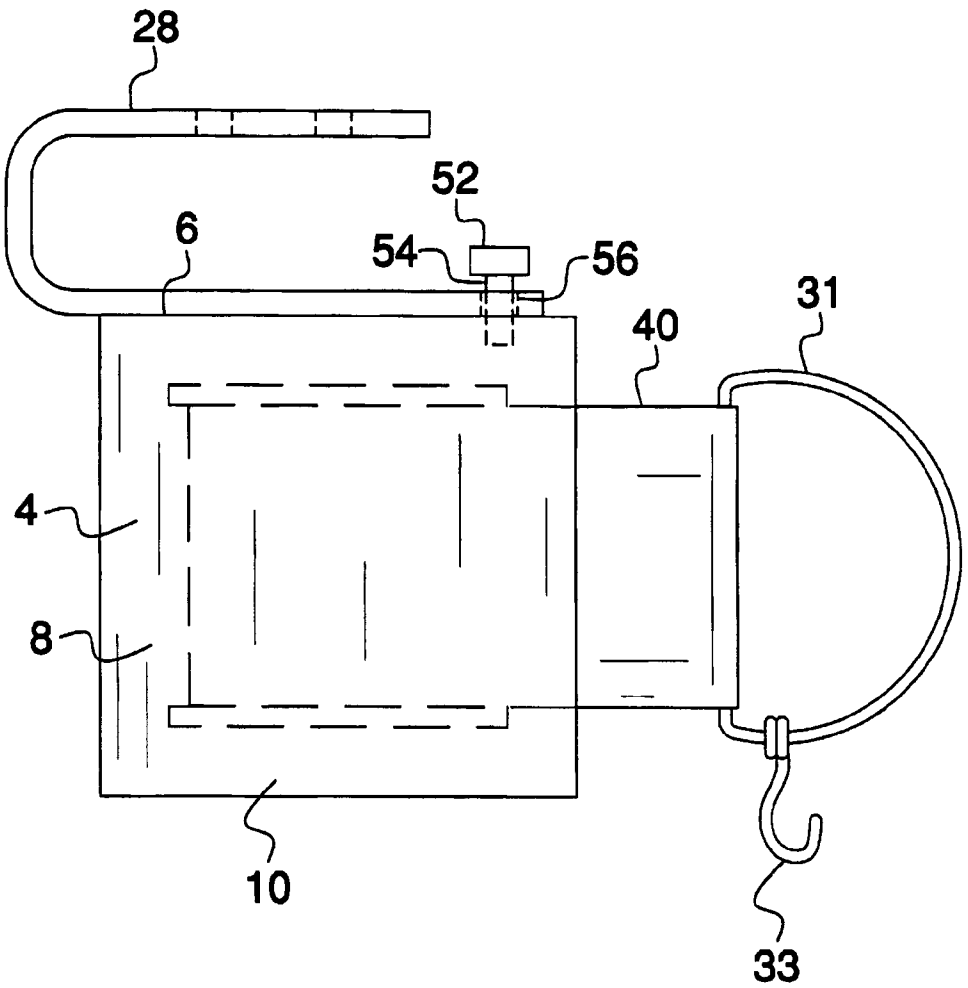
FIG. 4 shows a side view of a casing, highlighting the nylon stand that has been extended out of the casing.
Figure 5:
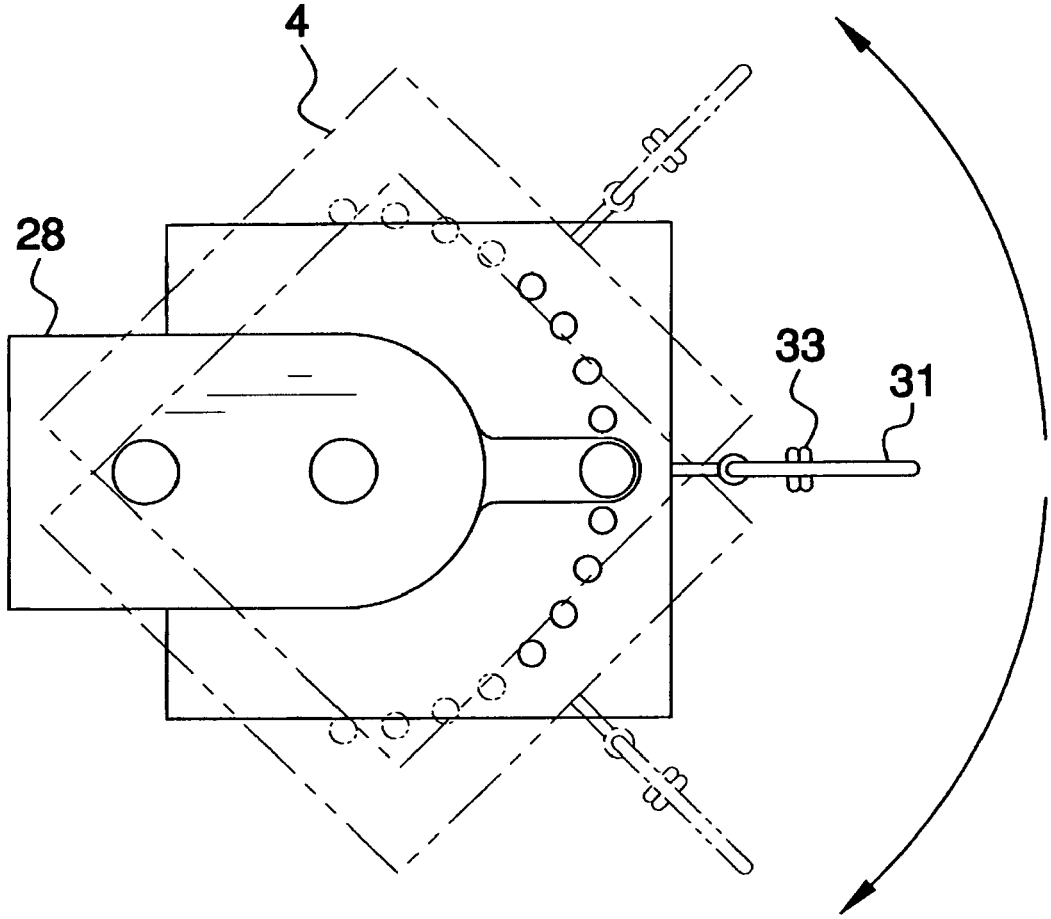
FIG. 5 shows a side view of a casing, highlighting the positioning of the flexibility of casing.
Figure 6:
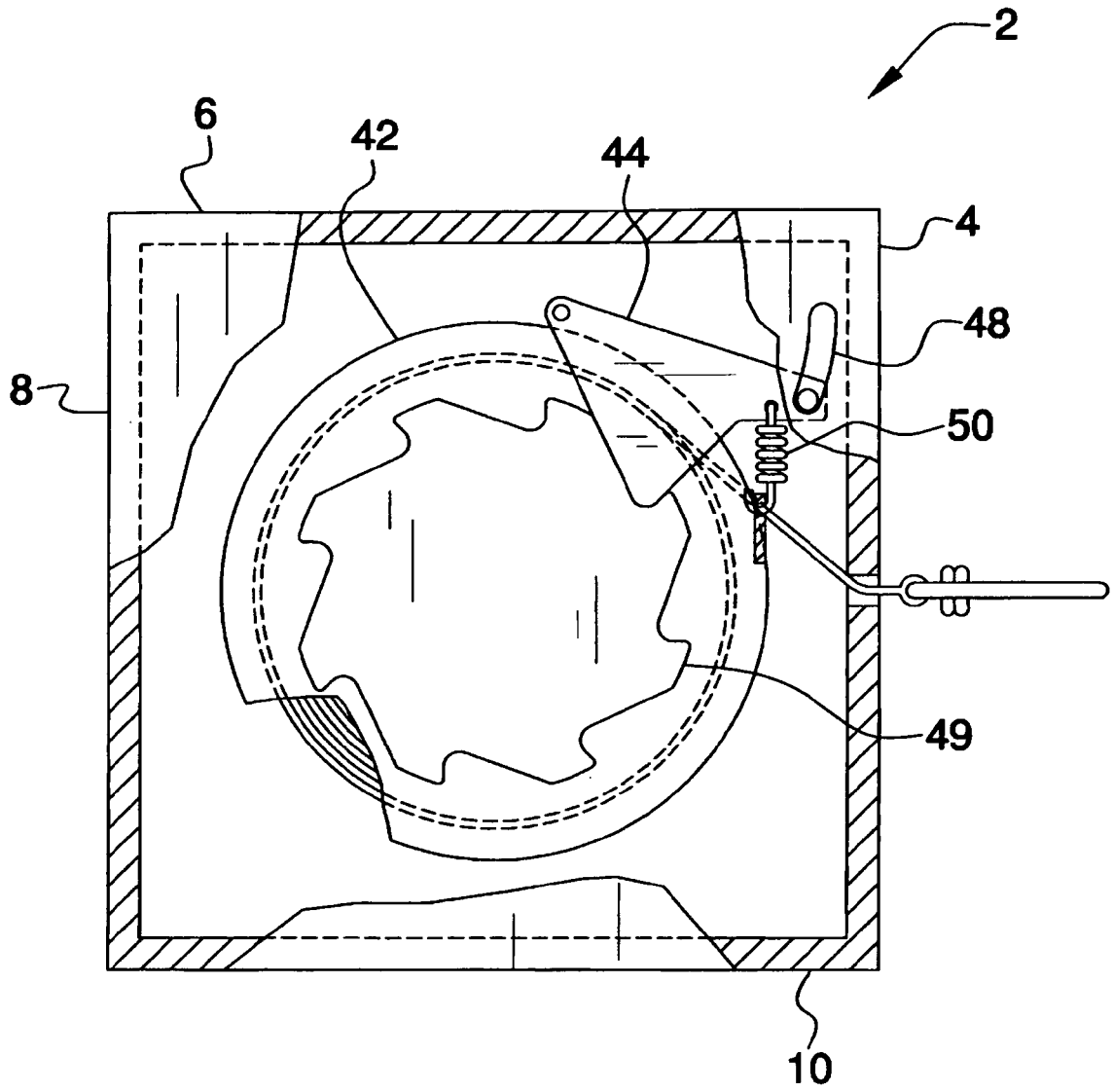
FIG. 6 shows a top breakaway view of a casing.

With reference now to the drawings, and in particular to FIGS. 1 through 6 thereof, a commercial vehicle safety barrier 2 embodying the principles and concepts of the present invention and generally designated by the reference numeral 2 will be described.

As best illustrated in FIGS. 1 through 6, the commercial vehicle safety barrier 2 comprises an outer casing 4, with the outer casing 4 preferably being cube-shaped. The outer casing 4 has a top surface 6, a quartet of side surfaces 8, and a bottom surface 10. The outer casing 4 is preferably cube- or box-shaped.

At least four commercial vehicle safety barriers 2 are designed to be used in conjunction with a fuel truck 12. Typically, a fuel truck 12 will have a tanker portion 14 that includes a large volume of fuel 16. Once a fuel truck 12 reaches its intended destination, the driver of such a fuel truck 12 needs to park his vehicle and hook up a hose 18 to one or more hose manifolds 20. Although the truck driver usually puts up barriers or warnings signs as to the fact that gas is being pumped from the fuel truck 12 into a large holding tank 22 within the ground through a hose 18 connected to a hose manifold 20, many drivers are ignorant of these warnings and/or deliberately try to drive around a fuel truck 12 in this situation, thereby endangering everyone. The commercial vehicle safety barrier 2 helps to prevent this type of situation. The commercial vehicle safety barrier 2 may also be used in conjunction with police and emergency vehicles as well as utility trucks to provide notification of dangerous or emergency situations or other situations requiring notice.

Each of the outer casings 4 of the commercial vehicle safety barriers 2 are attached to the frame 26 of the tanker portion 14 of the fuel truck 12 by a U-shaped attaching bracket 28. Each bracket 28 has two ends comprising an upper end 30 and a lower end 32, with the lower end 32 of each bracket 28 being removably attached to the top surface 6 of the outer casing 4. The upper end 30 of the U-shaped attaching bracket 28 is fixedly attached to the frame 26 of the tanker portion 14 of the fuel truck 12.

Each outer casing 4 has an internal strap 40 that is wound around a retractable spool 42. The spool 42 is axially mounted within the outer casing 4. The spool 42 continuously has an inward force pulling against it, but is prevented from automatically pulling in the strap 40 by a latch 44, which is attached to the outer casing 4 within the outer casing 4 by a latch pivot 36. The latch 44 interacts with a ratcheted gear 49 that is attached to the spool 42, allowing the spool 42 to independently stay in position while the strap 40 is in a pulled-out position. Each latch 44 can be released by a latch release knob 48, accessible through the outer casing 4, and has a spring 50 that helps keep the rigidity within the latch 44. The spring 50 is attached to both the latch 44 and the outer casing 4. The internal strap 40 may display a plurality of words 60. The words 60 form a plurality of messages 62 to inform passersby of the presence of danger or an emergency. For example, one of the messages 62 may be 'DO NOT ENTER' as illustrated in FIG. 1. Another of the messages 62 may be 'DANGER—GASOLINE—NO SMOKING.'

Each internal strap 40 is preferably fabricated from nylon and has an end-mounted loop 31 that includes an S-shaped hook 33. Through the hook 33, an individual can extend the strap 40 out a good length and attached the hook 33 to a cone 35, a fence 37, or a similarly fixed object.

The lower end 32 of each bracket 28 is attached to the top surface 6 of the outer casing 4 by inserting a lock pin 52 through a hole 54 located on the bracket 28 and a locking hole 56 located on the top surface 6 of the outer casing 4. The hole 56 on the top surface 6 of the outer casing 4 is one of a number of locking holes 56 that are placed on the top surface 6 in a semi-circular shape 58, allowing the outer casing 4 to be placed mounted in one of about fifteen to twenty positions in relation to the frame 26 of the tanker portion 14 of the fuel truck 12. Assuming that the default position of the outer casing 4 in relation to the frame 26 is one in which the side surface 8 wherein the strap 40 can be pulled out is facing away from the fuel truck 12, the actual movable range of the outer casing 4 in relation to the frame 26 is about ninety degrees, with the actual positioning of the outer casing 4 ranging from forty-five degrees left of center to forty-five degrees right of center.

With respect to the above description then, it is to be realized that the optimum dimensional relationships for the parts of the present vehicle air freshener device to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A commercial vehicle safety barrier comprising
- an outer casing, the outer casing having a top surface, the outer casing also having a plurality of side surfaces, the outer casing also having a bottom surface,
- an internal strap located within the outer casing,
- means for maintaining the internal strap within the outer casing,
- means for mounting at least one outer casing on a tanker portion of a fuel truck
- means for maintaining the strap in a pulled-out position once the strap has been pulled out of the outer casing,
- wherein the outer casing has a box shape or cube shape,
- wherein the means for mounting at least one outer casing on a tanker portion of a fuel truck further comprises
  - a bracket having two ends comprising an upper end and a lower end,
  - means for removably attaching the lower end of the bracket to the top surface of the outer casing,
  - a frame associated with the tanker portion of the fuel truck,
  - wherein the upper end of the bracket is fixedly attached to the frame of the tanker portion of a fuel truck,
  - wherein the means for removably attaching the lower end of the bracket to the top surface of the outer casing further comprises
  - a hole located in the bracket near the lower end of the bracket,
  - a plurality of locking holes located on the top surface of the outer casing,
  - a lock pin,
  - wherein the lock pin is inserted through a hole in the bracket and one of the holes of the plurality of locking holes located on the top surface of the outer casing,
- wherein the plurality of locking holes located on the top surface of the outer casing are placed in a semi-circular shape.

2. A commercial vehicle safety barrier according to claim 1 wherein the means for maintaining the internal strap within the outer casing further comprises
- (a) a retractable spool axially mounted within the outer casing,
- (b) a ratcheted gear attached to the spool,
- (c) a latch attached to the outer casing, wherein the latch interacts with the ratcheted gear,
- (d) wherein the internal strap is wound around the retractable spool,
- (e) further wherein the retractable spool has a continuously inward force pulling the internal strap into the outer casing.

3. A commercial vehicle safety barrier according to claim 2 wherein the means for maintaining the internal strap within the outer casing further comprises
- (a) a latch release knob accessible through the outer casing, the latch release knob being attached to the latch,
- (b) a spring attached to the latch, the spring also being connected to the outer casing,
- (c) wherein an individual can utilize the latch release knob to remove the latch from contact with the ratcheted gear, thereby allowing the retractable spool to pull the internal strap within the outer casing.

4. A commercial vehicle safety barrier according to claim 3 wherein the means for maintaining the strap in a pulled-out position once the strap has been pulled out of the outer casing further comprises (a) a loop attached to the strap, (b) a hook attached to the loop, (c) wherein the loop is attached to a fixed object once the strap has been pulled out of the outer casing.

5. A commercial vehicle safety barrier according to claim 4 wherein the strap is fabricated from nylon.

6. A commercial vehicle safety barrier according to claim 5 wherein the fixed object to which the strap is attached further comprises a cone.

7. A commercial vehicle safety barrier according to claim 5 wherein the fixed object to which the strap is attached further comprises a fence.

8. A commercial vehicle safety barrier comprising (a) an outer casing, the outer casing having a top surface, the outer casing also having a plurality of side surfaces, the outer casing also having a bottom surface, the outer casing having a box shape or cube shape, (b) an internal strap located within the outer casing, wherein the strap is fabricated from nylon, (c) means for maintaining the internal strap within the outer casing, said means further comprising (i) a retractable spool axially mounted within the outer casing, (ii) a ratcheted gear attached to the spool, (iii) a latch attached to the outer casing, wherein the latch interacts with the ratcheted gear, (iv) wherein the internal strap is wound around the retractable spool, (v) further wherein the retractable spool has a continuously inward force pulling the internal strap into the outer casing, (vi) a latch release knob accessible through the outer casing, the latch release knob being attached to the latch, (vii) a spring attached to the latch, the spring also being connected to the outer casing, (viii) wherein an individual can utilize the latch release knob to remove the latch from contact with the ratcheted gear, thereby allowing the retractable spool to pull the internal strap within the outer casing, (d) means for mounting at least one outer casing on a tanker portion of a fuel truck, said means further comprising (i) a bracket having two ends comprising an upper end and a lower end, (ii) means for removably attaching the lower end of the bracket to the top surface of the outer casing, said means further comprising (1) a hole located in the bracket near the lower end of the bracket, (2) a plurality of locking holes located on the top surface of the outer casing, wherein the plurality of locking holes located on the top surface of the outer casing are placed in a semi-circular shape, (3) a lock pin, wherein the lock pin is inserted through a hole in the bracket and one of the holes of the plurality of locking holes located on the top surface of the outer casing, (iii) a frame associated with the tanker portion of the fuel truck, (iv) wherein the upper end of the bracket is fixedly attached to the frame of the tanker portion of a fuel truck, (e) means for maintaining the strap in a pulled-out position once the strap has been pulled out of the outer casing, said means further comprising (i) a loop attached to the strap, (ii) a hook attached to the loop, (iii) wherein the loop is attached to a fixed object once the strap has been pulled out of the outer casing.

9. A commercial vehicle safety barrier according to claim 8 wherein the fixed object to which the strap is attached further comprises a cone.

10. A commercial vehicle safety barrier according to claim 8 wherein the fixed object to which the strap is attached further comprises a fence.

11. A commercial vehicle safety barrier according to claim 8 wherein the strap further comprises a plurality of words, wherein said words form a plurality of messages.

* * * * *